US007385346B2

(12) United States Patent
Chen

(10) Patent No.: US 7,385,346 B2
(45) Date of Patent: Jun. 10, 2008

(54) ELECTRON SOURCE INCLUDING MAGNETIC COILS AND SURFACE LIGHT SOURCE DEVICE USING SAME

(75) Inventor: Ga-Lane Chen, Fremont, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/440,244

(22) Filed: May 24, 2006

(65) Prior Publication Data

US 2007/0057620 A1 Mar. 15, 2007

(30) Foreign Application Priority Data

Sep. 9, 2005 (CN) ..... 2005 1 0037211

(51) Int. Cl.
*H01J 1/62* (2006.01)

(52) U.S. Cl. ..... 313/496; 313/153; 313/582

(58) Field of Classification Search ..... 313/153, 313/160–163, 422, 442, 629, 293; 315/5, 315/169.3, 169.4
See application file for complete search history.

(56) References Cited

U.S. PATENT DOCUMENTS 2,761,089 A * 8/1956 Haeff ..... 315/12.1
3,740,554 A * 6/1973 Morgan, Jr. ..... 250/423 R
5,808,408 A * 9/1998 Nakamoto ..... 313/484
6,291,943 B1 9/2001 Murai et al.
2004/0069952 A1* 4/2004 Katsumura et al. ..... 250/397
2005/0093418 A1* 5/2005 Kraus et al. ..... 313/293

* cited by examiner

*Primary Examiner*—Joseph L Williams
*Assistant Examiner*—Britt Hanley
(74) *Attorney, Agent, or Firm*—Jeffrey T. Knapp

(57) ABSTRACT

A surface light source device (2) includes a plurality of electron sources (20), a plurality of magnetic coils (201), and an anode (22). Each electron source includes two cathodes (203) and at least one filament (202). The two cathodes face to each other and define therebetween a space (200) having a first opening (207) and a second opening (208). The second opening faces to and is larger than the first opening. The at least one filament is located at the second opening and is configured for emitting electrons to escape the space from the first opening. Each magnetic coil is located at one second opening. The anode includes a transparent electrically conductive layer (222) and a phosphorescent layer (221). The phosphorescent layer faces towards the plurality of electron source. The present surface light source device can achieve high brightness and is environmentally friendly.

18 Claims, 4 Drawing Sheets

ELECTRON SOURCE INCLUDING MAGNETIC COILS AND SURFACE LIGHT SOURCE DEVICE USING SAME

BACKGROUND

1. Technical Field

The present invention relates to electron sources and surface light source devices using the same and, more particularly, to a surface light source device used in a liquid crystal display (LCD) device.

2. Description of the Related Art

In recent years, LCD devices, such as liquid crystal monitors, and liquid crystal TVs have become widely used. A typical LCD device includes an LCD panel and a surface light source device positioned under the LCD panel for supplying light thereto.

The surface light source device mainly includes at least one light source and a light guide plate (LGP). The LGP is normally a transparent plate, and is used for guiding light emitted by the light source to uniformly illuminate the LCD panel. The light source generally is a light-emitting diode (LED) or a cold cathode fluorescence lamp (CCFL) containing gas mercury. When the CCFL is used in the surface light source device, the mercury in the CCFL may be released into the atmosphere if the CCFL is scrapped. However, the mercury is poison material for environment.

What is needed, therefore, is a surface light source device that is environmentally friendly.

SUMMARY

An electron source according to one preferred embodiment includes two cathodes and at least one filament. The two cathodes face to each other and define therebetween a space having a first opening and a second opening. The second opening faces to and is larger than the first opening. The at least one filament is located at the second opening and is configured for emitting electrons to escape the space from the first opening.

A surface light source device according to another preferred embodiment includes a plurality of electron source, a plurality of magnetic coils, and an anode. Each electron source includes two cathodes and at least one filament. The two cathodes face to each other and define therebetween a space having a first opening and a second opening. The second opening faces to and is larger than the first opening. The at least one filament is located at the second opening and is configured for emitting electrons to escape the space from the first opening. The anode includes a transparent electrically conductive layer and a phosphorescent layer. The phosphorescent layer faces towards the plurality of electron source.

Other advantages and novel features will become more apparent from the following detailed description of present electron source and surface light source device, when taken in conjunction with the accompanying drawings.

BRIEF DESCRIPTION OF THE DRAWINGS

Many aspects of the present electron source and surface light source device can be better understood with reference to the following drawings. The components in the drawings are not necessarily to scale, the emphasis instead being placed upon clearly illustrating the principles of the present electron source and surface light source device. Moreover, in the drawings, like reference numerals designate corresponding parts throughout the several views.

DETAILED DESCRIPTION OF PREFERRED EMBODIMENTS

Reference will now be made to the drawings to describe preferred embodiment of the present electron source and surface light source device, in detail.

Figure 1:
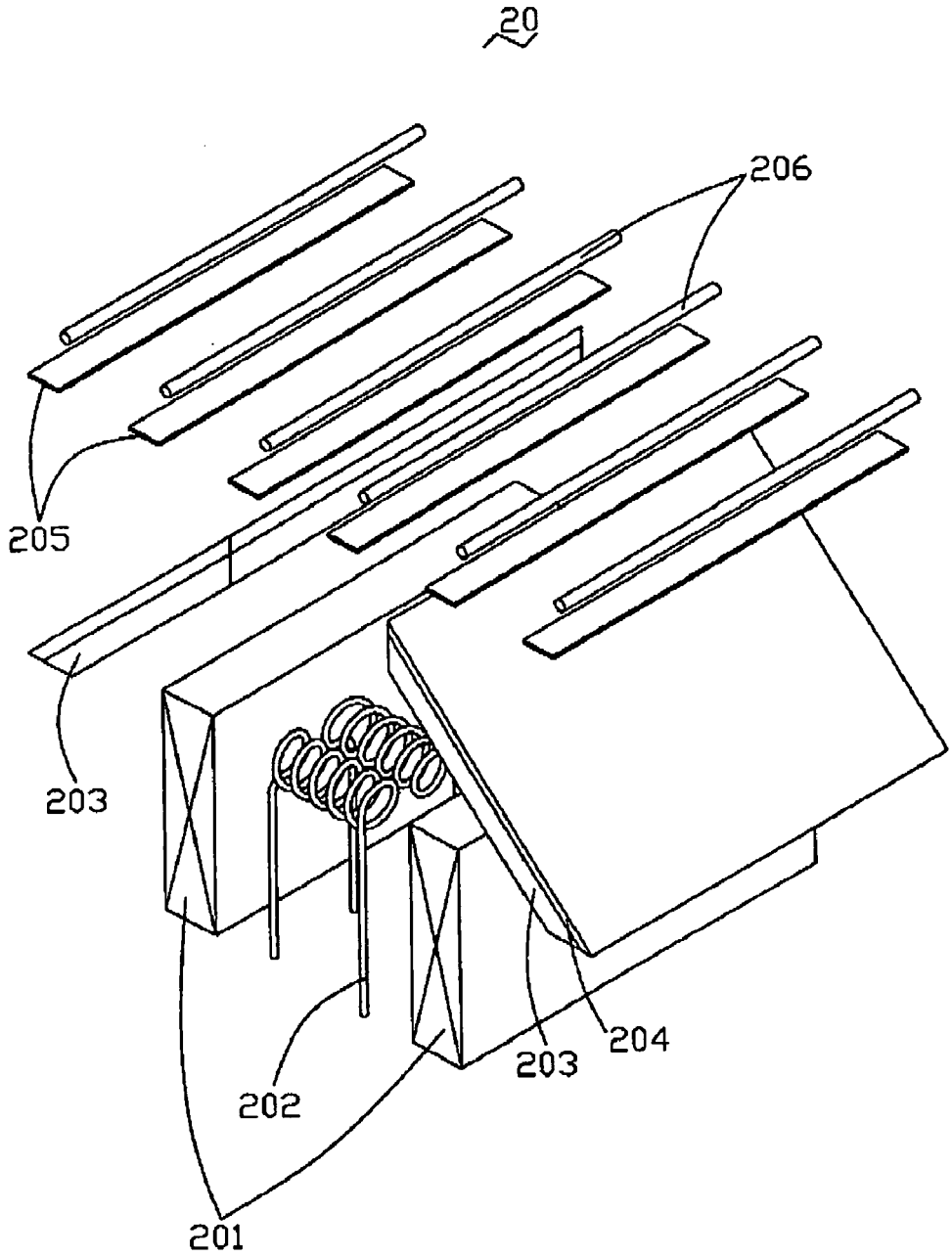
FIG. 1 is a schematic, isometric view of an electron source, in accordance with a first embodiment.
Figure 2:
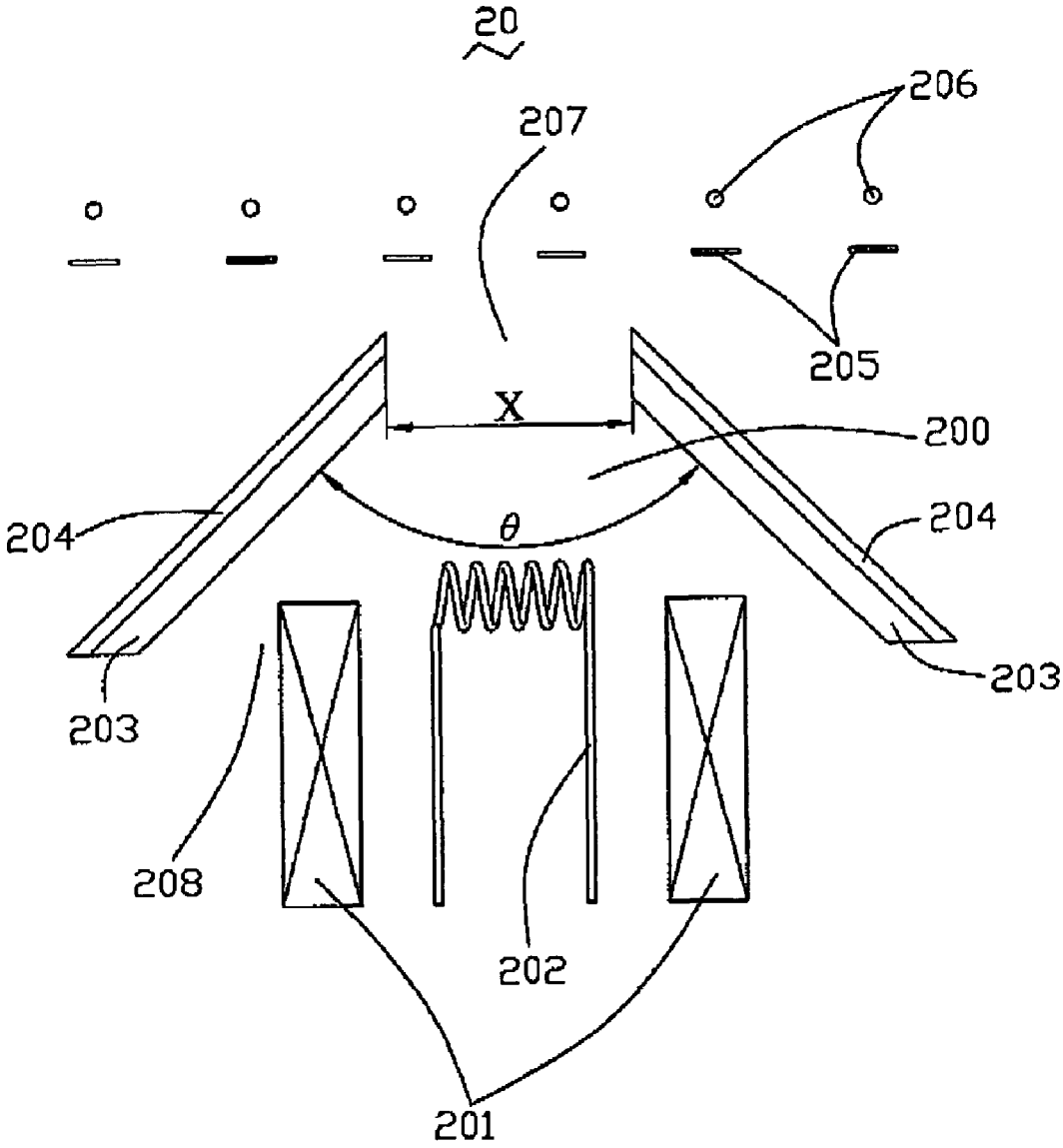
FIG. 2 is a schematic, plan view of the electron source of FIG. 1.

Referring to FIGS. 1 and 2, an electron source 20 in accordance with a first embodiment, is shown. The electron source 20 includes a magnetic coil 201, a plurality of filaments 202, two cathodes 203, a screen grid 205, and an accelerator grid 206.

The filament 202 is configured for emitting electrons when an electrical current flows therethrough. The electrical current can be applied to the filament 202 via a power supply (not shown). The two cathodes 203 face to each other and form a space 200 therebetween. The two cathodes 203 define a first opening 207 and a second opening 208 facing to and larger than the first opening 207. The filament 202 and the magnetic coil 201 are located at the second opening 208, and the magnetic coil 201 is preferably adjacent to the filament 202. Preferably, the two cathodes 203 are positioned symmetrically. A distance X between the two cathodes 203 at the first opening 207 preferably ranges from 1 mm to 5 mm. An angle is defined between the two cathodes 203, and the angle θ preferably ranges from 40 degrees to 120 degrees. Thus, the electrons emitted by the filament 202 can be extracted efficiently from the first opening 207. The screen grid 205 and the accelerator grid 206 are located near the first opening 207 in that order. The screen grid 205 can reduce scattering of the electrons. The accelerator grid 206 can change electrical field and accelerate the electrons.

In order to protect the two cathodes 203 from bombarding by at least one of returning ions and secondary electrons, a dielectric overcoat 204 is coated on an outer surface of each of the two cathodes. Preferably, the dielectric overcoat 204 can be selected from the group consisting of aluminum oxide ($Al_2O_3$), magnesium oxide (MgO) and silicon oxide ($SiO_2$).

Figure 3:
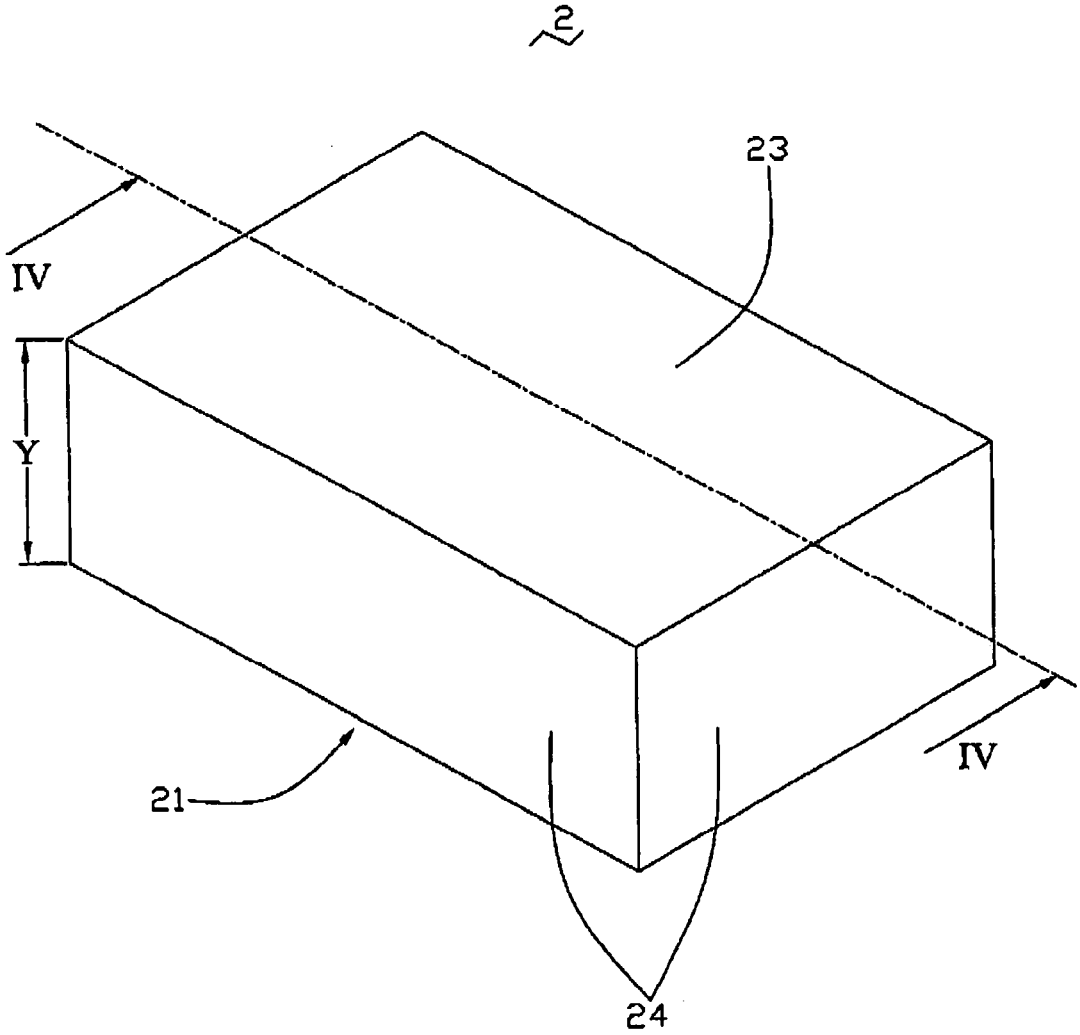
FIG. 3 is a schematic, isometric view of a surface light source device, in accordance with a second embodiment.
Figure 4:
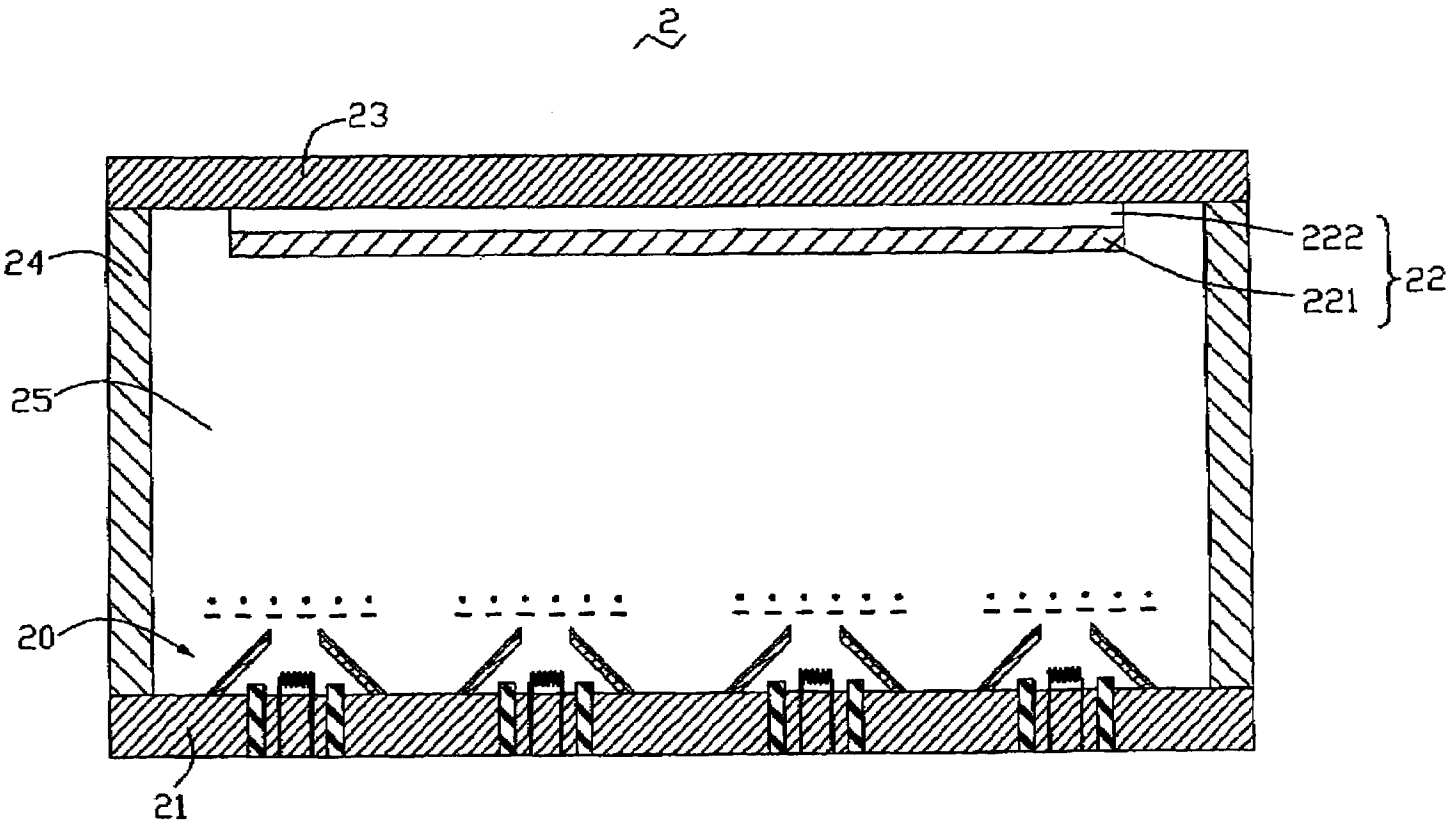
FIG. 4 is a cross-sectional view of the surface light source device of FIG. 3, taken along line IV-IV of FIG. 3.

Referring to FIGS. 3 and 4, a surface light source device 2 in accordance with a second embodiment, is shown. The surface light source device 2 includes a plurality of above-mentioned electron sources 20, a first base plate 21, an anode 22, a second base plate 23, and a sealing frame 24. The first base plate 21, the second base plate 23 and the sealing frame 24 together define a sealed space. An inert gas 25 is contained in the sealed space. An outer surface of the second base plate 23 functions as a light-emitting surface of the surface light source device 2.

The first base plate 21 is configured for supporting the plurality of electron sources 20 in the surface light source device 2. The anode 22 includes a transparent electrically conductive layer 222 and a phosphorescent layer 221. The transparent electrically conductive layer 222 and the phosphorescent layer 221 are formed on an inner surface of the second base plate 23 in that order. Preferably, the phosphorescent layer 221 is a white light phosphorescent layer, and its thickness ranges from 500 nm to 50 μm, more preferably from 1 μm to 10 μm. The transparent electrically conductive layer 222 can be selected from the group consisting of indium tin oxide (ITO), zinc oxide (ZnO) and indium zinc oxide ($In_2O_3$—ZnO). The inert gas 25 can be a mixture of Ne—Xe, Ne—Ar, Ne—He—Ar, Ne—He—Ar—Xe, or Ne—Xe—Kr—Ar. The first base plate 21 and the second base plate 23 are preferably transparent base plates, more preferably glass base plates. A thickness Y of the surface light source device 2 preferably ranges from 1 cm to 10 cm, more preferably from 2 cm to 5 cm.

In operation, a DC power supply can be applied to the anode 22 and the cathode 203. Thus, an electrical field and a magnetic field generated by the magnetic coil 201 are formed in the surface light source device 2. When the filaments 202 are heated and emit electrons, the electrons move towards the anode 22 under the action of the electrical field, the magnetic field and the accelerator 206. During moving, the electrons strike the inert gas 25 and the inert gas 25 is ionized. When the inert gas 25 is ionized, it can emit ultraviolet light. The ultraviolet light can excite the phosphorescent layer 221 and make the phosphorescent layer 221 emit visible light. As known in the art, the ionization ratio is proportional to electrical field multiplied magnetic field, so the present surface light source device 2 can achieve high brightness. At the same time, the present surface light source device 2 is environmentally friendly because no mercury is used therein.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. An electron source, comprising:

two cathodes facing to each other and defining therebetween a space having a first opening and a second opening, the second opening facing and being larger than the first opening, wherein at least one of the following two conditions is met:

a distance between the two cathodes at the first opening ranges from 1 mm to 5 mm; and an angle is defined between the two cathodes, and the angle ranges from 40 degrees to 120 degrees;

pair of magnetic coils located at the second opening; and at least one filament located between the magnetic coils at the second opening and configured for emitting electrons to escape the space from the first opening.

2. The electron source as claimed in claim 1, wherein a dielectric overcoat is coated on an outer surface of each of the two cathodes opposing the at least one filament.

3. The electron source as claimed in claim 1, further comprising a screen grid and an accelerator grid being located near the first opening in that order.

4. A surface light source device, comprising:

a plurality of electron sources, wherein each electron source comprises two cathodes and at least one filament, the two cathodes face to each other and define therebetween a space having a first opening and a second opening, the second opening faces to and is larger than the first opening, the at least one filament is located at the second opening and is configured for emitting electrons to escape the space from the first opening;

a plurality of magnetic coils, wherein each magnetic coil is located at one second opening; and an anode comprising a transparent electrically conductive layer and a phosphorescent layer, wherein the phosphorescent layer faces towards the plurality of electron source.

5. The surface light source device as claimed in claim 4, further comprising a first base plate, a second base plate, a sealing frame and an inert gas, wherein the first base plate is configured for supporting the plurality of electron sources, the second base plate is configured for supporting the anode, the first base plate, the second base plate and the sealing frame together define a sealed space for containing the inert gas.

6. The surface light source device as claimed in claim 5, wherein the inert gas is a mixture selected from one of Ne—Xe, Ne—Ar, Ne—He—Ar, Ne—He—Ar—Xe, and Ne—Xe—Kr—Ar.

7. The surface light source device as claimed in claim 5, wherein the second base plate is a transparent base plate.

8. The surface light source device as claimed in claim 7, wherein the second base plate is a glass base plate.

9. The surface light source device as claimed in claim 4, wherein the phosphorescent layer is a white light phosphorescent layer.

10. The surface light source device as claimed in claim 4, wherein a thickness of the phosphorescent layer ranges from 500 nm to 50 μm.

11. The surface light source device as claimed in claim 10, wherein the thickness of the phosphorescent layer ranges from 1 μm to 10 μm.

12. The surface light source device as claimed in claim 4, wherein the transparent electrically conductive layer is selected from the group consisting of indium tin oxide, zinc oxide, and indium zinc oxide.

13. The surface light source device as claimed in claim 4, wherein a distance between the two cathodes at the first opening ranges from 1 mm to 5 mm.

14. The surface light source device as claimed in claim 4, wherein an angle is defined between the two cathodes, and the angle ranges from 40 degrees to 120 degrees.

15. The surface light source device as claimed in claim 4, wherein a dielectric overcoat is coated on an outer surface of each of the two cathodes opposing the at least one filament.

16. The surface light source device as claimed in claim 4, further comprising a screen grid and an accelerator grid being located on the first opening in that order.

17. A light module comprising:

a sealed chamber filling inert gas therein;

an anode disposed within the chamber and comprising a transparent electrically conductive layer and a phosphorescent layer;

a plurality of electron sources disposed within the chamber and spaced from the anode, each of the electron sources comprising two cathodes facing to each other with a space formed therebetween, the space having a small opening and a large opening, a pair of magnetic coils located at the large opening, a filament located between the magnetic coils at the large opening and configured for emitting electrons which is capable of escaping the space via the small opening to strike the phosphorescent layer when a voltage is applied to the anode and the cathodes.

18. The light module of claim 17, further comprising a screen grid and an accelerator grid located adjacent to the small opening.

* * * * *